United States Patent [19]

Smith

[11] Patent Number: 4,534,586

[45] Date of Patent: Aug. 13, 1985

[54] AUTOMATIC LOCKING DEVICE

[75] Inventor: Arnold R. Smith, Chester, N.J.

[73] Assignee: AT&T Bell Laboratories, Murray Hill, N.J.

[21] Appl. No.: 454,158

[22] Filed: Dec. 29, 1982

[51] Int. Cl.[3] ..... E05C 3/14

[52] U.S. Cl. ..... 292/228; 292/DIG. 38

[58] Field of Search ..... 292/57, 64, 128, 228, 292/DIG. 38; 403/359

[56] References Cited

U.S. PATENT DOCUMENTS

| | | | |
|---|---|---|---|
| 751,495 | 2/1904 | Gauchet | 292/57 |
| 849,800 | 4/1907 | Lowthorp | 292/57 X |
| 2,802,682 | 8/1957 | Enckevort | 292/228 X |
| 2,924,474 | 2/1960 | Lange | 292/128 |
| 3,302,964 | 2/1967 | Barry | 292/57 |
| 3,689,757 | 9/1972 | Valshammer | 292/64 X |
| 4,061,371 | 12/1977 | Prather et al. | 292/198 |
| 4,203,461 | 5/1980 | Schwitters | 403/359 X |
| 4,226,454 | 10/1980 | Tranberg et al. | 403/359 X |
| 4,362,036 | 12/1982 | Shanklin | 292/DIG. 38 X |

FOREIGN PATENT DOCUMENTS

| | | | |
|---|---|---|---|
| 2656858 | 6/1978 | Fed. Rep. of Germany | 292/64 |
| 312389 | 5/1929 | United Kingdom | 292/228 |

*Primary Examiner*—Gary L. Smith
*Assistant Examiner*—Russell W. Illich
*Attorney, Agent, or Firm*—Harry L. Newman; John Francis Moran

[57] ABSTRACT

An automatic locking device (402) is disclosed that can be utilized to secure a first member (40) to a second member (10). The device includes a latching member (12) with an integral spring member (18), the latching member being attached to a bolt member (11). The bolt member (11) is inserted into the first member (40) and then is inserted in an opening (15) in the latching member (12). Thereafter, an E-shaped retaining ring (13) is attached to a shank end of the bolt member (11) to secure the bolt member (11) to the latching member (12). The spring member (18) is continuously biased via a projecting portion (410) in the first member (40). When the first and second members are properly engaged with one another, the latch member (12) enters a detent (116) in the second member (10) and retains the first member (40) securely in place. Thereafter, the bolt member (11) can be rotated to release the latching member (12) from the detent (116) facilitating detachment of the first member (40) from the second (10).

2 Claims, 7 Drawing Figures

AUTOMATIC LOCKING DEVICE

BACKGROUND OF THE INVENTION

1. Field of the Invention

The present invention relates to automatic locking devices and, more particularly, is concerned with locking devices which are capable of simply and easily locking a movable member to a stationary member or to another movable member, and, subsequently, simply and easily unlocking the members. Even more particularly, the present invention relates to automatic locking devices for locking and unlocking access members, such as covers, panels, doors and the like, which provides access or entry to various enclosures of all kinds.

2. Description of the Prior Art

Automatic locking devices are utilized in a variety of constructs to secure one member to another. It is well-known that there are many commercially available automatic locking devices on the market today. However, there is always a need for simpler and easier to operate devices. There is also a need for such a device where environmental conditions adversely effect the operation of the device. Oftentimes, precipitation from rain, snow or the like, prevents the locking device from operating properly particularly if the device is made from metal. The precipitation, over time, will corrode the device, making it inoperable. It would be beneficial, therefore, to provide a simple, easy to operate automatic locking device which is also weather resistant.

SUMMARY OF THE INVENTION

In accordance with an illustrative embodiment, an automatic locking device for securing one member to another comprises a latch member with an integral spring member, a bolt member which is inserted through and coupled to the latch member, and a retaining member for securing the latch member onto the bolt member. In this embodiment the latching member and bolt member are advantageously produced from a plastic material.

This particular device can be used in conjunction with a cable pedestal closure such as my invention described in co-pending application Ser. No. 454,160 filed Dec. 29, 1982. The pedestal closure disclosed in this application incorporates the locking device of this invention with an upper front member to facilitate attachment of the front member to a stationary rear member, thus providing a secure, substantially tamper resistant closure.

In this illustrative embodiment, the bolt member is inserted through a circular-like opening in the upper front member, a shank end of the bolt member extending into an inside portion of the front member. A head end of the bolt member has a wide keyway which is mated to a narrow key in the opening in the front member. The keyway and key cooperate to limit the rotation of the bolt member. This serves to prevent overstressing of the spring member and also provides for the continuous biasing of the spring member by always maintaining it in a position in which it is deflected by a projecting portion of the front member. The latch member is attached to the shank end via an opening in a hub of the latch member, and thereafter a securing means, in this embodiment, an E-shaped retaining ring, is attached to the shank end of the bolt member to secure the latch member to the bolt member. Additionally, the latch member has keyways in the opening that are mated to keys or protrusions on the bolt member to couple and properly position the latch member in relation to the bolt member.

When the latch member is properly in position as before described, the integral spring of the latch member is biased by the projecting portion of the upper front member. When sidewalls of the upper front member are inserted into grooves of the rear member and the upper front member is properly engaged, the latch member will enter a detent in the rear member. The latch member remains within the detent through the continued rearward biasing of the spring member by the projecting member and thus the front member is automatically locked to the rear member. A head of the bolt member is rotated via a special tool to remove the latch member from the detent. The upper front member can then be released from the rear member.

The automatic locking device of this invention will find use whenever one member is to be secured to another. As before-mentioned the device can be advantageously formed principally from a plastic material to facilitate a unitary structural design. This device can also be configured such that, in combination with a member, it incorporates a tamper resistant design, while at the same time allowing authorized personnel to easily enter the closure or like assembly.

DETAILED DESCRIPTION

Figure 1:
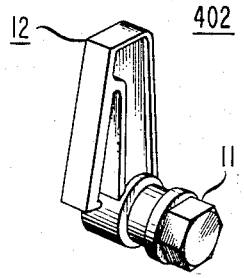
FIG. 1 is a perspective view of an illustrative embodiment of the automatic locking device of this invention.

FIG. 1 illustrates the major components of the automatic locking device 402 of my invention assembled to one another. The automatic locking device 402 is composed principally of a plastic material. The plastic material to be chosen should exhibit two characteristics to be suitable for use; fire resistance and toughness. A typical material that provides these properties is polycarbonate (PC) and is one of several candidates. Generally speaking, the material utilized to form the automatic locking device should be compatible with the material utilized to form the enclosure.

The automatic locking device 402 effectively secures one member to another member. One illustrative use is in conjunction with a pedestal closure to secure a front member to a rear member. A pedestal closure, as is well known, is utilized in conjunction with buried cable and the like to facilitate service wire connections from customer's premises to the telephone service. An example of a pedestal closure that utilizes the automatic locking device of my invention to advantage is described in my copending application Ser. No. 454,160 filed Dec. 29, 1982.

Figure 2:
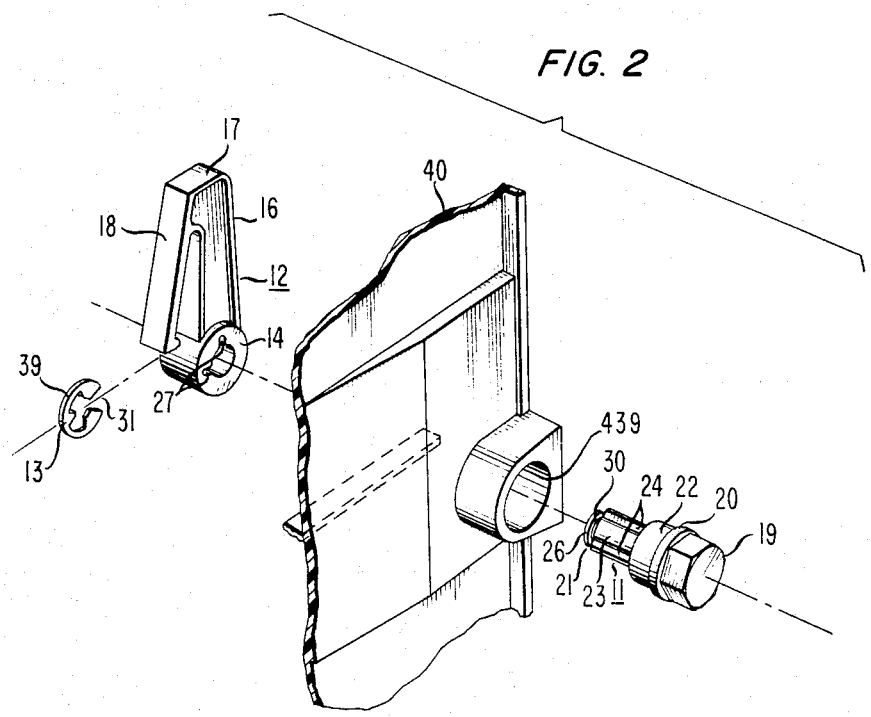
FIG. 2 is a partially cutaway exploded view of the device being attached to a front member.

FIG. 2 shows a partially cutaway exploded view of the automatic locking device 402 being attached to a front member 40 of such a pedestal closure. The locking device 402 comprises a bolt member 11 having a head portion 20 at one end including, in this embodiment, a hexagonal shaped head 19 to accommodate a tool. The hexagonal shape of head 19 is for illustrative purposes only and it is well recognized by those skilled in the art that it can be in a variety of shapes to accommodate different shaped tools. The head portion 20 further includes cylindrical shaft portion 22.

The other end of the bolt member 11 comprises a shank end portion 21 including a cylindrical rod-like portion 23 with raised key members 24. The shank end portion 21 further includes a small diameter end portion 26 separated from the portion 23 by a groove 30 adapted to accommodate a retaining ring 13.

The rod-like portion 23 of the bolt member 11 as indicated is inserted into an opening 15 in a circular hub portion 14 of a latch member 12. The raised key members 24 are matched to keyways 27 in the opening 15 to insure that the bolt member 11 is always coupled in the proper relation to the latch member 12. The bolt member 11, like the latch member 12, is a unitary structure readily produced by the injection molding process.

Figure 3:
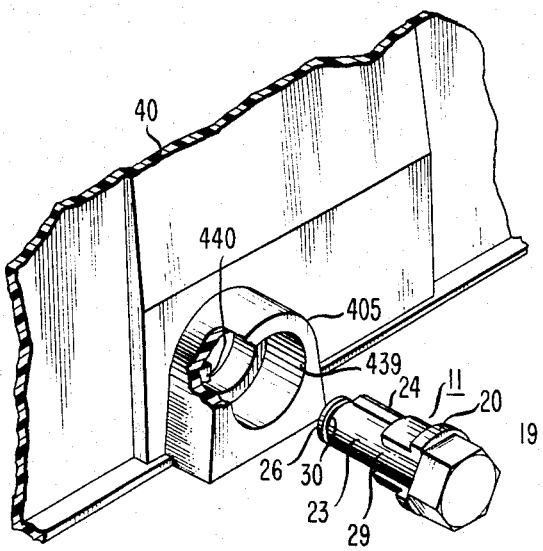
FIG. 3 is a partially cutaway view of a bolt member being attached to the front member, the front member being rotated 90° to show particular details.

Referring to FIG. 3, the shaft portion 22 of the head portion 20 of the bolt member 11 has a wide opening or keyway 29 within it, and the keyway 29 mates with a narrow key 440 in an opening 439 of the front member 40. The keyway 29—key 440 combination performs two functions: (1) it allows only limited rotation of the latch member 12 and (2) it causes a spring member 18 to the latch member 12 to be continuously biased by always maintaining it in a position in which it is deflected by a projecting member 410 (FIG. 2) of the front member 40. Referring back to FIG. 2, the latch member 12 further comprises a locking member 16 extending from the circular hub portion 14 and the flat integral spring member 18 which is spaced apart from the locking member 16 by an arcuate projection 17.

The E-shaped semicircular retaining ring 13 secures the bolt member 11 to the latch member 12. The retaining ring is placed in groove 30 of the bolt member to "capture" the member 11 on the latch member 12. Retaining member 13 through the insertion of portions 39 and 31 to the groove 30 of the bolt member 11 secures the latch member 12 to the bolt member 11 at the circular end portion 26.

The retaining ring 13 can be manufactured from metal but can just as readily be formed from plastic material via the before mentioned injection molding process.

Figure 4:
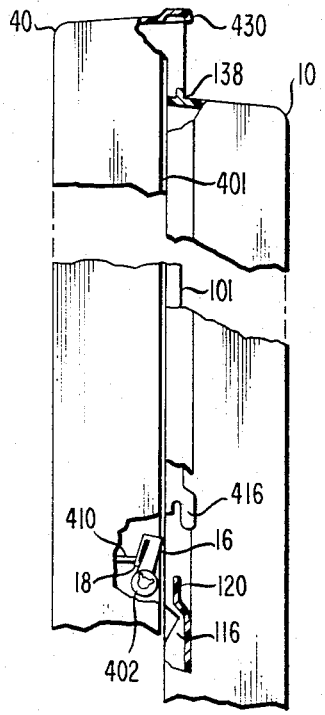
FIG. 4 is a cutaway side view of the front member being attached to a rear member utilizing the locking device of my invention.
Figure 5:
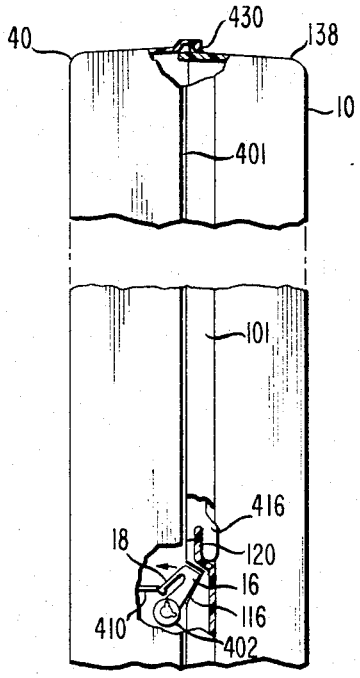
FIG. 5 shows the same view as FIG. 4 with the locking device securing the front member to the rear member.
Figure 6:
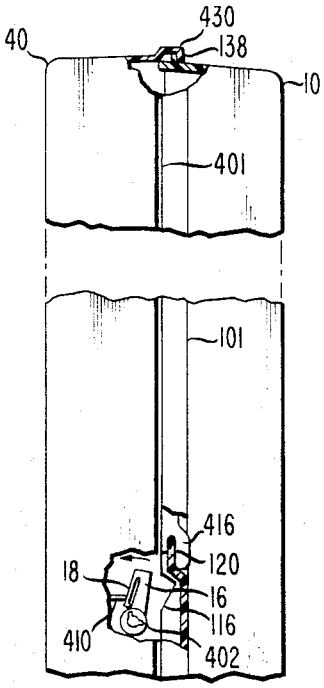
FIG. 6 shows the same view as FIG. 5 with the locking device rotated.

In operation, the locking device 402 rotates between two positions, a first position, such as shown in FIG. 6 where the latch member 12 is out of the path of a rear member 10, and a second position such as shown in FIG. 5 where the latch member 12 is engaged with a detent 116 of the rear member 10. The spring member 18 biases the locking device 402 toward the second position. The operation of the locking device is described in more detail in the following discussion with reference to FIGS. 4–6.

FIG. 4 illustrates by cutaway side view the front member 40 being engaged and latched to the rear member 10. For illustrative purposes these members are part of a pedestal closure for underground cables, similar to the one described in copending patent application Ser. No. 454,160 filed Dec. 29, 1982.

In this FIG. rearwardly extending side walls 401 engage the grooves 101 on each side of the rear member 10. After side walls 401 are inserted therein, member 40 can be pushed downward. Spring member 18 as seen in the cutaway view is biased by the projecting member 410 such that the locking member 16 is resting against groove 101. When the member 40 is pushed downward a sufficient distance as shown in FIG. 5, hook member 416 of the front member 40 engages a flange 120 of the rear member 10 and also a lip 430 at top of member 10 engages a flange 138 of rear member 10. The locking member 16 simultaneously engages a detent 116 in the rear member 10, thus locking the front member 40 to the rear member 10.

As seen in FIG. 6, when the locking member 16 is rotated out of the detent 116 the front member 40 can then be pulled up a short distance to free the engagement of hooks 416 and lip 430 and thereafter front member 40 can be lifted away from the rear member 10.

Thus, this locking device 402 is utilized in combination with hook-flange and lip-flange engagement to firmly secure the two members together. This arrangement allows for a coordinated method for attaching the two members together.

Figure 7:
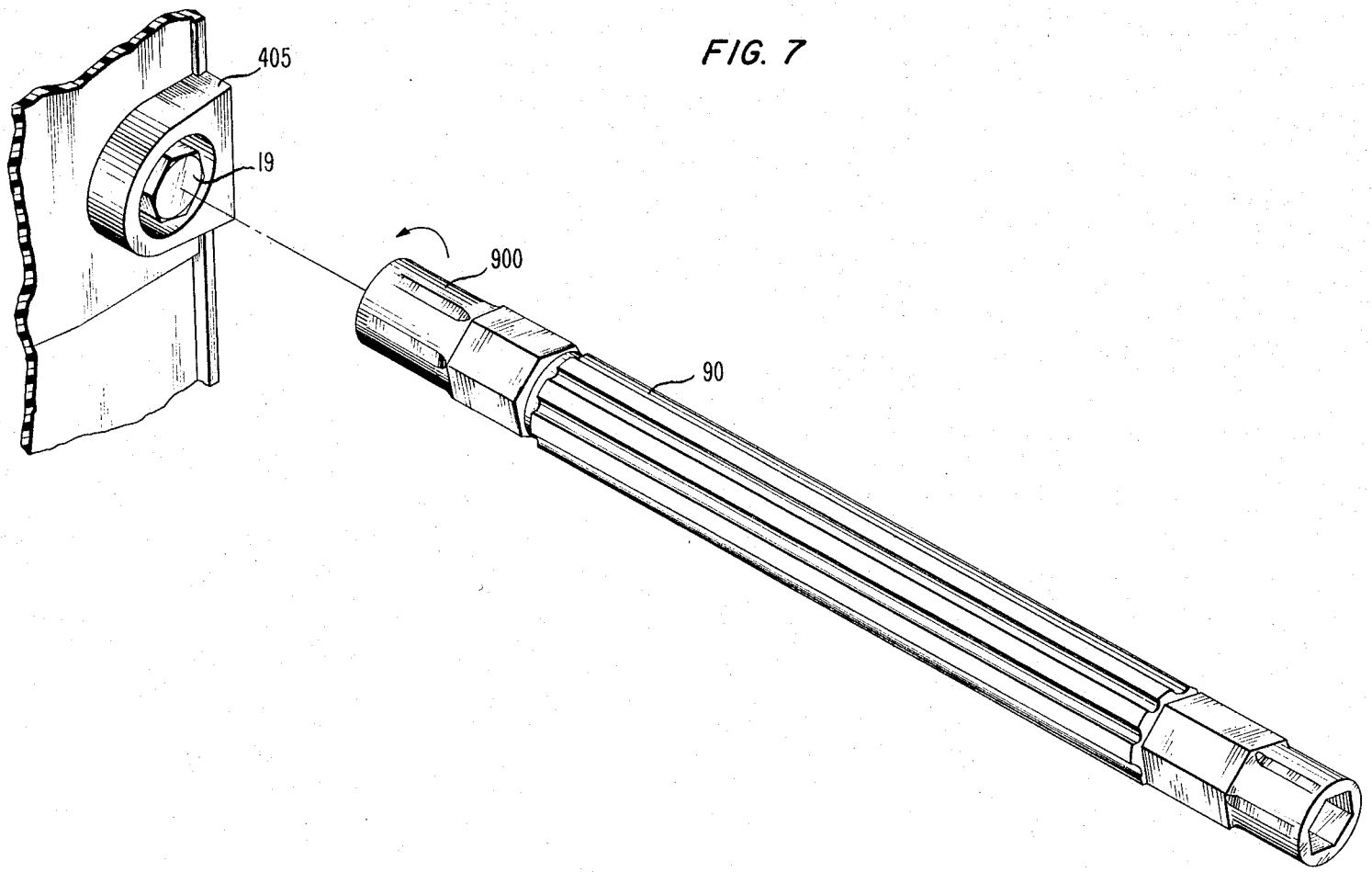
FIG. 7 is a cutaway view of a portion of the front member and a special tool used in conjunction with the removal of the front member from the rear member.

Oftentimes, it is important that the locking device be inaccessible to unauthorized personnel. Thus, in this embodiment, as seen in FIG. 7, the bolt head 19 is surrounded by circular portion 405 in the front member 40 to prevent access by unauthorized personnel using conventional socket wrenches and the like.

A special tool 90 is utilized that is adapted to turn the bolt member 11. In this embodiment, the socket 900 of the tool 90 would be of the hexagonal variety. Those skilled in the art, however, recognize the socket configuration could be of any variety that accommodates the bolt head 19. The locking device in this embodiment is used in conjunction with cable pedestal closures, but those skilled in the art recognize that this device could be utilized in many different settings to secure one member to another.

This embodiment has various and important advantages over previous automatic locking devices. The locking mechanism can be molded from a plastic material to allow it to be a unitary structure. The spring, being an integral part of the mechanism, does not have to be separately produced and also no attachment hardware is required. Similarly, the opening within the latch member and the integral keyways can be advantageously manufactured via a plastic molding process, rather than manufacturing them by a stamping or punching operation which would create wasted material. It is also well recognized that the shape of the locking device is one of many that could be utilized to secure the members together.

In all cases it is to be understood that the above-described embodiments are illustrative of one of many possible specific embodiments which represent applications of the principles of the invention. Thus, numerous and various other embodiments can be devised readily in accordance with these principles by those skilled in the art without departing from the spirit and scope of my invention.

What is claimed is:

1. An automatic locking device for securing a first member to a second member comprising:

a latch member connected to the first member, the latch member upon attachment of the first member to the second member being inserted into a detent within the second member, a spring member the spring member extending at an angle thereto, integral to the latch member, the spring member biased by a projecting member within the first member, and a bolt member detachably connected to the latching member, the bolt member further comprising;

a head member at one end and a shank portion at the other end, the head member being rotatable such that the latch member is outside of the detent, thereby facilitating the detachment of the first member from the second, the head member further having a slot, the slot having predetermined boundaries for mating to a key within an opening in the first member, the slot boundaries are at an angle to each other approximately equal to said spring member angle, the slot thereby preventing the overstressing of the latch member when rotating the head member and the slot also providing the continuous biasing of the spring member with the projecting member.

2. An automatic locking device for securing a first member to a second member comprising:

a latch member connected to the first member, the latch member upon attachment of the first member to the second member being inserted into a detent within the second member, a spring member integral to the latch member, the spring member extending at an angle thereto, the spring member biased by a projecting member within the first member, and a bolt member detachably connected to the latching member, the bolt member further comprising;

a head member at one end and a shank portion at the other end, the head member during attachment of the first member to the second member being in a first and then a second position, the first position being where the latch member is biased against a sidewall of the second member, the second position being where the latch member is inserted into the detent thereby securing the first member to the second, the head member being rotatable such that the latch member is outside of the detent, thereby facilitating the detachment of the first member from the second, the head member further having a slot, the slot having predetermined boundaries for mating to a key within an opening in the first member, the slot boundaries are at an angle to each other approximately equal to said spring member angle, the slot thereby preventing the overstressing of the latch member when rotating the head member and the slot also providing the continuous biasing of the spring member with the projecting member.

* * * * *